US009473871B1

(12) United States Patent
Ma et al.

(10) Patent No.: US 9,473,871 B1
(45) Date of Patent: Oct. 18, 2016

(54) SYSTEMS AND METHODS FOR AUDIO MANAGEMENT

(71) Applicant: Marvell International Ltd., Hamilton (BM)

(72) Inventors: Ye Ma, Shanghai (CN); Bei Wang, Shanghai (CN)

(73) Assignee: MARVELL INTERNATIONAL LTD., Hamilton (BM)

( * ) Notice: Subject to any disclaimer, the term of this patent is extended or adjusted under 35 U.S.C. 154(b) by 67 days.

(21) Appl. No.: 14/568,157

(22) Filed: Dec. 12, 2014

Related U.S. Application Data

(60) Provisional application No. 61/925,504, filed on Jan. 9, 2014.

(51) Int. Cl.
*H04S 7/00* (2006.01)

(52) U.S. Cl.
CPC ..... *H04S 7/303* (2013.01)

(58) Field of Classification Search
None
See application file for complete search history.

(56) References Cited

U.S. PATENT DOCUMENTS 6,181,800 B1 * 1/2001 Lambrecht ..... H04S 1/002 381/17
7,917,236 B1 * 3/2011 Yamada ..... G10K 15/02 381/18
2004/0196991 A1 * 10/2004 Iida ..... H04S 1/005 381/309
2006/0056638 A1 * 3/2006 Schobben ..... H04S 1/002 381/17
2006/0072764 A1 * 4/2006 Mertens ..... H04S 1/00 381/56
2008/0056503 A1 * 3/2008 McGrath ..... H04S 3/00 381/17
2009/0041254 A1 * 2/2009 Jin ..... H04S 7/304 381/1
2009/0122995 A1 * 5/2009 Kim ..... G10L 21/028 381/17
2009/0214045 A1 * 8/2009 Fukui ..... H04S 1/005 381/17
2010/0266133 A1 * 10/2010 Nakano ..... H04R 3/04 381/17
2010/0322428 A1 * 12/2010 Fukui ..... H04S 7/30 381/17
2015/0010160 A1 * 1/2015 Udesen ..... H04R 25/70 381/60
2015/0055783 A1 * 2/2015 Luo ..... H04S 5/00 381/17

* cited by examiner

*Primary Examiner* — Thang Tran

(57) ABSTRACT

System and methods are provided for audio management. Initial head-related transfer function (HRTF) parameters indicating an initial virtual configuration of a plurality of audio sources are determined. A first user operation is detected through a user interface. Target HRTF parameters are generated in response to the first user operation. A target virtual configuration of the plurality of audio sources is determined based at least in part on the target HRTF parameters.

20 Claims, 13 Drawing Sheets

SYSTEMS AND METHODS FOR AUDIO MANAGEMENT

CROSS-REFERENCE TO RELATED APPLICATIONS

This disclosure claims priority to and benefit from U.S. Provisional Patent Application No. 61/925,504, filed on Jan. 9, 2014, the entirety of which is incorporated herein by reference.

FIELD

The technology described in this patent document relates generally to signal processing and more particularly to audio management.

BACKGROUND

Mobile devices (e.g., smart phones, tablets) often perform audio signal processing. Various audio signals (e.g., phone calls, music, radio, video, games, system notifications, etc.) may need to be mixed or routed in mobile devices. Different strategies may be implemented to control the mixing or routing of audio streams. For example, music playback may be muted during a phone call and then resume when the phone call is finished.

Information about spatial location of a simulated audio source to a listener over audio equipment (e.g., headphones, speakers, etc.) is often determined using head-related transfer function (HRTF) parameters. HRTF parameters are associated with digital audio filters that reproduce direction-dependent changes that occur in magnitudes and phase spectra of audio signals reaching left and right ears of the listener when the location of the audio source changes relative to the listener. HRTF parameters can be used for adding realistic spatial attributes to arbitrary sounds presented over headphones or speakers.

SUMMARY

In accordance with the teachings described herein, system and methods are provided for audio management. Initial head-related transfer function (HRTF) parameters indicating an initial virtual configuration of a plurality of audio sources are determined. A first user operation is detected through a user interface. Target HRTF parameters are generated in response to the first user operation. A target virtual configuration of the plurality of audio sources is determined based at least in part on the target HRTF parameters.

In one embodiment, a system for audio management includes: one or more data processors; and a computer-readable storage medium encoded with instructions for commanding the one or more data processors to execute certain operations. Initial head-related transfer function (HRTF) parameters indicating an initial virtual configuration of a plurality of audio sources are determined. A first user operation is detected through a user interface. Target HRTF parameters are generated in response to the first user operation. A target virtual configuration of the plurality of audio sources is determined based at least in part on the target HRTF parameters.

In another embodiment, a system for audio management includes: a computer-readable medium, a user interface, and one or more data processors. The computer-readable medium is configured to store an initial virtual configuration of a plurality of audio sources and initial head-related transfer function (HRTF) parameters associated with the initial virtual configuration of the plurality of audio sources. The user interface is configured to receive a user operation for audio management. The one or more data processors are configured to: detect the user operation through the graphical user interface; generate target HRTF parameters in response to the user operation; store the target HRTF parameters in the computer-readable medium; determine a target virtual configuration of the plurality of audio sources based at least in part on the target HRTF parameters; and store the target virtual configuration in the computer-readable medium.

DETAILED DESCRIPTION

During audio signal processing for mobile devices, if multiple audio streams are rendered at the same time, it is usually chaotic because different audio signals may interfere with each other. In addition, a listener may not be able to conveniently adjust volumes of these audio signals. A common audio management strategy involves rendering only one audio stream at a time. However, this strategy has some disadvantages. For example, if a listener wants to listen to music during a phone call, the listener may have to switch the phone application to background, and then open a music player to play music, while the phone call may be unnecessarily interrupted or put on hold.

Figure 1:
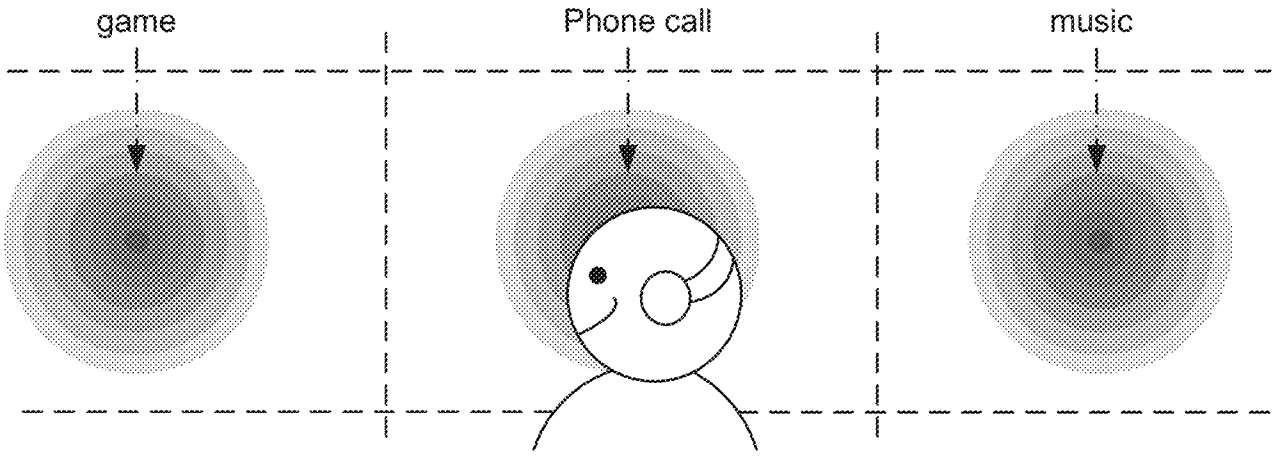
FIG. 1 depicts an example diagram for rendering multiple audio streams.
Figure 2:
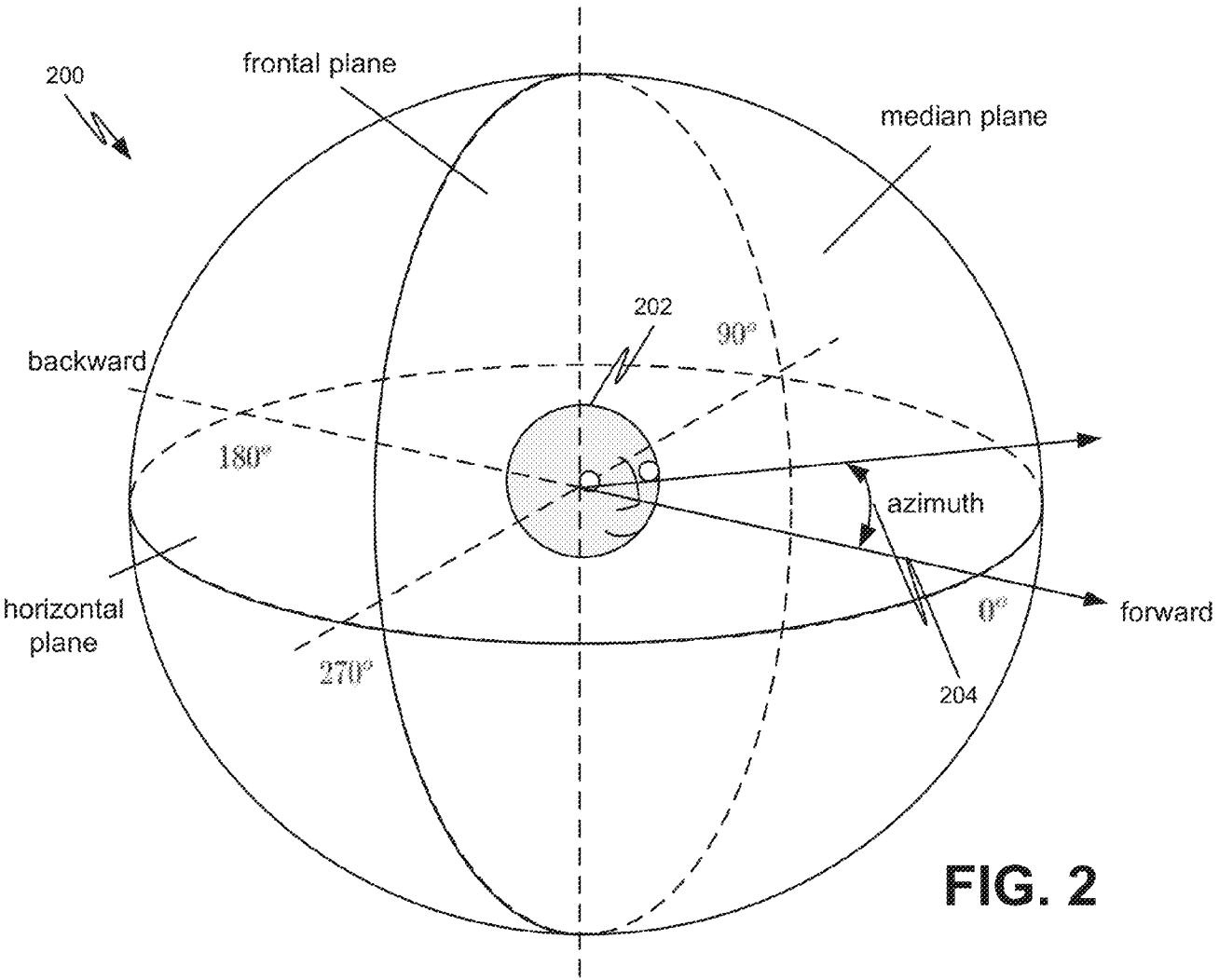
FIG. 2 depicts an example diagram showing a virtual three-dimensional space.

FIG. 1 depicts an example diagram for rendering multiple audio streams. As shown in FIG. 1, multiple audio streams, such as game sounds, phone calls, music, etc., are rendered with a single audio device (e.g., a headphone, a speaker, etc.). A virtual configuration of a plurality of audio sources associated with the audio streams is determined using head-related transfer function (HRTF) parameters for a listener. That is, to the listener, the audio streams appear to come from different directions so that the listener can distinguish these audio streams easily. As shown in FIG. 2, the virtual configuration indicates the positions of the plurality of audio sources relative to the listener 202 in a virtual three-dimensional space 200. For example, the plurality of audio sources may be located on a horizontal plane, a frontal plane, a median plane, etc., of the virtual three-dimensional space 200.

Figure 3:
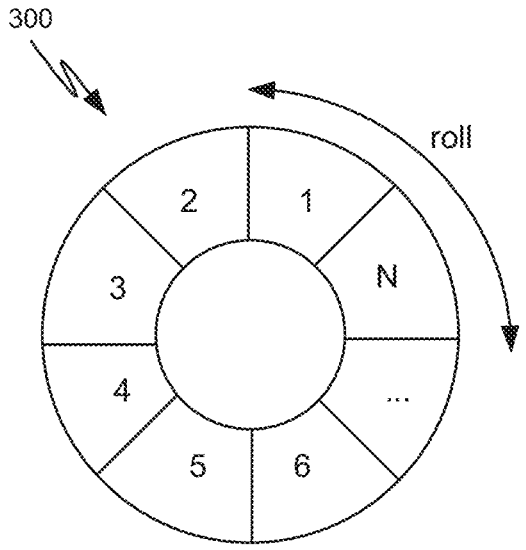
FIG. 3 depicts an example diagram showing a ring panel implemented on a user interface for control a virtual configuration of a plurality of audio sources.

FIG. 3 depicts an example diagram showing a ring panel implemented on a user interface for control a virtual configuration of a plurality of audio sources. As shown in FIG. 3, a plurality of regions (e.g., "1," "2," . . . , "N") on the ring panel 300 correspond to the plurality of audio sources, and the configuration of the plurality of audio sources can be changed by a user operation (e.g., dragging, rolling, etc.) on the ring panel 300. For example, the ring panel 300 is used for a headphone on a mobile device (e.g., a smart phone, a tablet).

Figure 4A:
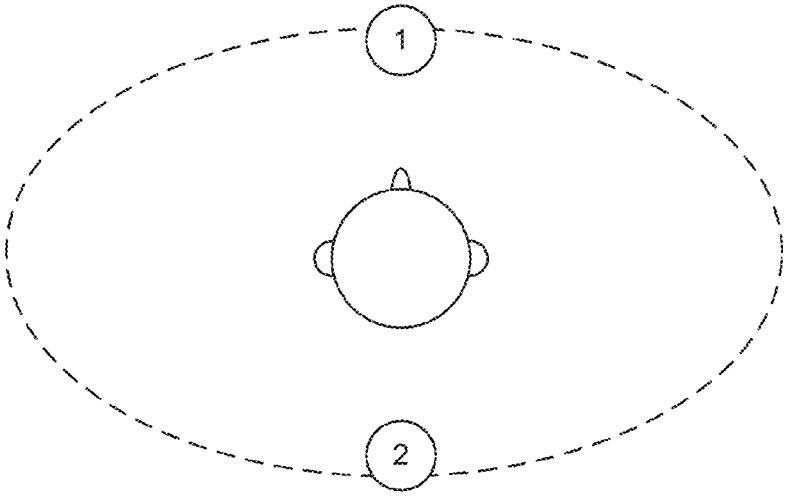
FIG. 4(A)-FIG. 6(B) depict example diagrams showing different virtual configurations of audio sources and ring panels.
Figure 4B:
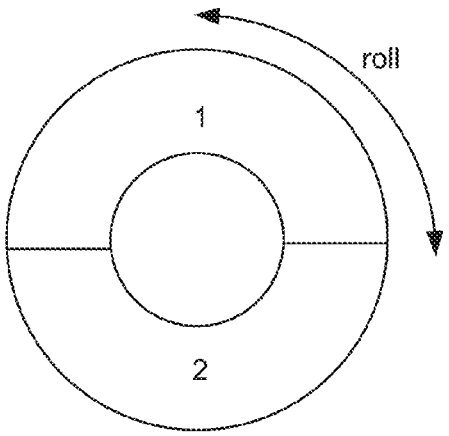

Specifically, the regions "1," "2," . . . , "N" indicate different audio sources that provide audio streams to a listener currently. In one embodiment, if a listener is in a phone call while listening to music, N is equal to 2. As shown in FIG. 4(A), the virtual configuration of the two audio sources involves one audio source (e.g., for the music) being placed in front of the listener and another audio source (e.g., for the phone call) being placed behind the listener. Correspondingly, there are only two regions on the ring panel, as shown in FIG. 4(B). The listener may perform user operations on the ring panel to change the virtual configuration of the two audio sources. For example, when the listener is listening to music, the region "1" that corresponds to the music is at the top of the ring panel, and the region "2" that corresponds to the phone call is at the bottom of the ring panel. If a phone call comes in, the listener wants to pick up the phone while keeping playing the music in the background, and thus the listener rolls (e.g., clockwise or counterclockwise) the ring panel so that the region "1" and the region "2" switch places. Correspondingly, the virtual configuration of the two audio sources changes. That is, the audio source for the phone call is placed in front of the listener and the audio source for the music is placed behind the listener.

Figure 5A:
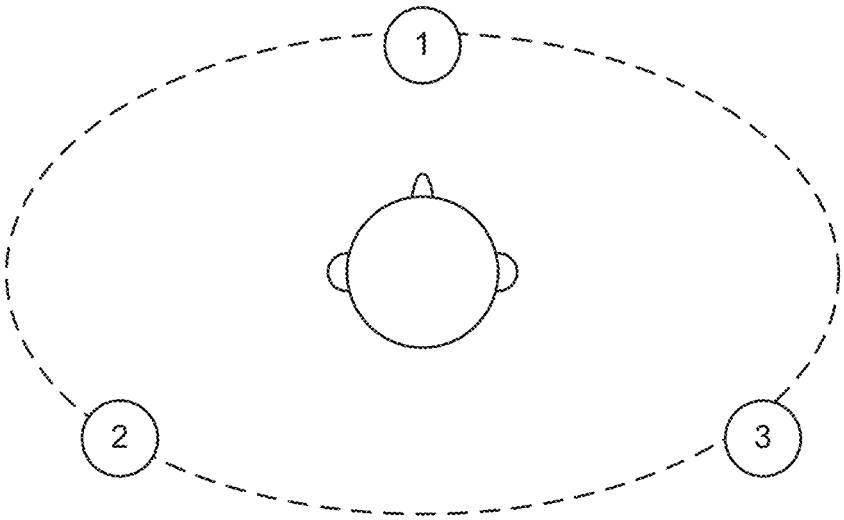
Figure 5B:
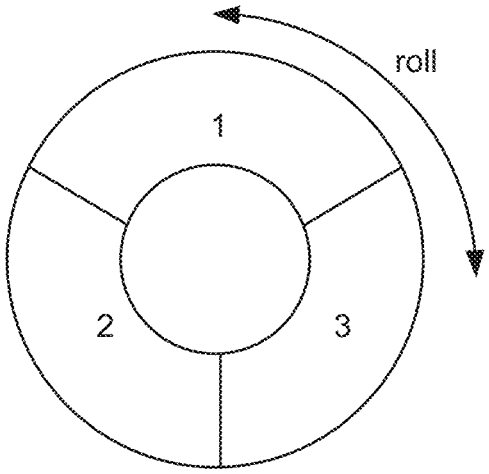

In another embodiment, if there are three audio sources, such as a phone call, music, and game sounds, N is equal to 3. The virtual configuration of the three audio sources is shown in FIG. 5(A). For example, the three audio sources may form a triangle on a horizontal plane of the virtual three-dimensional space. Correspondingly, there are three regions on the ring panel, as shown in FIG. 5(B). The listener may perform user operations on the ring panel to change the virtual configuration of the three audio sources, e.g., in response to certain events.

Figure 6A:
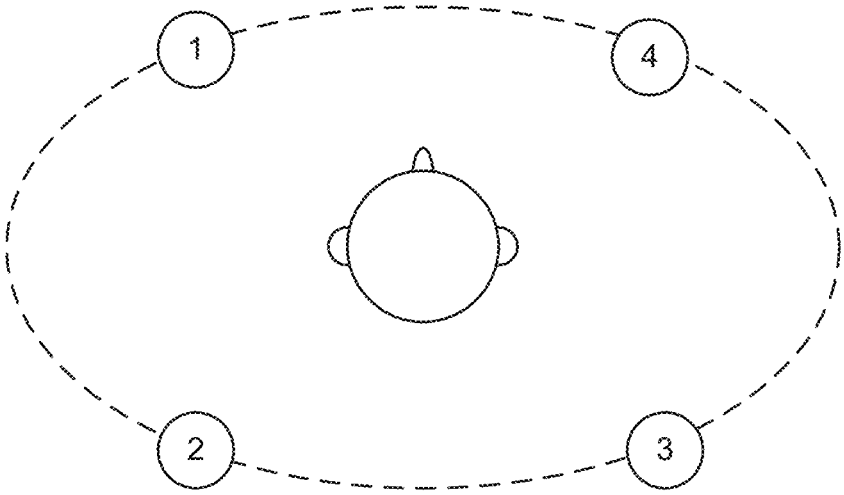
Figure 6B:
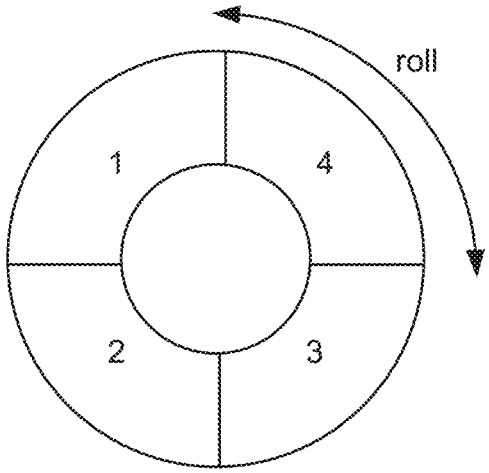

In yet another embodiment, if there are four audio sources, N is equal to 4. The virtual configuration of the four audio sources is shown in FIG. 6(A). For example, the four audio sources may form a square or a rectangle on a horizontal plane of the virtual three-dimensional space. Correspondingly, there are four regions on the ring panel, as shown in FIG. 6(B). The listener may perform user operations on the ring panel to change the virtual configuration of the four audio sources, e.g., in response to certain events.

Figure 7:
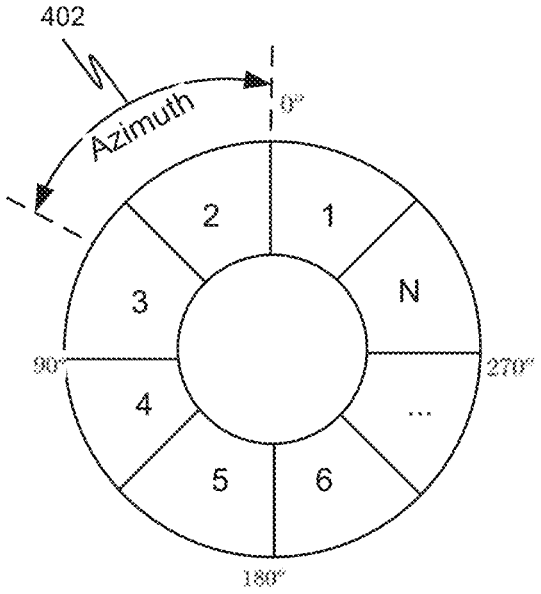
FIG. 7 depicts an example diagram showing azimuth changes in a ring panel.

The HRTF parameters are determined based at least in part on one or more azimuth parameters associated with the plurality of audio sources. For example, an azimuth parameter includes a direction angle in a horizontal plane, as shown in FIG. 2. If the listener wants to change the virtual configuration of the plurality of audio sources, the listener can roll or drag the ring panel on the user interface (e.g., a graphical user interface) for a particular angle 402 (e.g., clockwise or counterclockwise) as shown in FIG. 7. In response, the azimuth parameters (e.g., direction angles) of the plurality of audio sources are changed for an amount 204, as shown in FIG. 2. Accordingly, the HRTF parameters are updated. Particularly, if the ring panel is rolled or dragged from 0° to 90°, then the plurality of audio sources rotate (e.g., clockwise or counterclockwise) around the listener for 90°.

Figure 8:
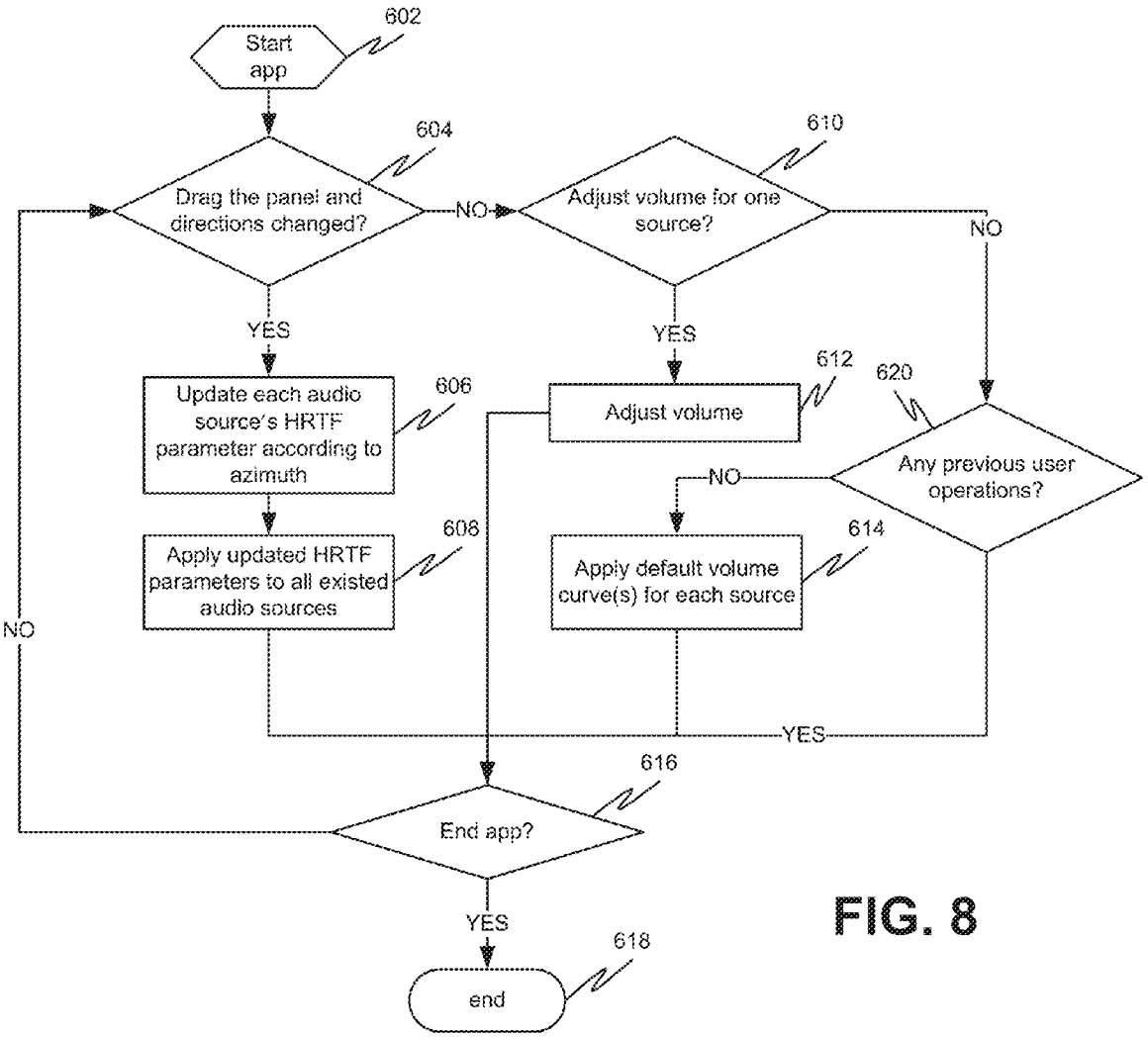
FIG. 8 depicts an example flow chart for audio management.

FIG. 8 depicts an example flow chart for audio management. At 602, a software application (or a hardware implementation) starts. A plurality of audio sources are detected, and initial HRTF parameters of the plurality of audio sources are determined. The initial HRTF parameters of the plurality of audio sources indicate a virtual configuration of the plurality of audio sources in a virtual three-dimensional space. At 604, a user operation is detected on a user interface. It is determined whether the user drags or rolls a ring panel to change the virtual configuration of the plurality of audio sources. If the virtual configuration of the plurality of audio sources is to be changed, at 606, the HRTF parameters for each audio source are updated according to one or more azimuth parameters (e.g., direction angles). At 608, the updated HRTF parameters are applied to all audio sources so as to generate a new virtual configuration. Then, at 616, it is determined whether the software application (or the hardware implementation) is to be ended.

If the virtual configuration of the plurality of audio sources is not to be changed (e.g., no user operation being detected, the user operation not including dragging or rolling, etc.), at 610, it is determined whether volumes for one or more audio sources are to be changed. If the volumes for one or more audio sources are to be changed, at 612, the volumes are adjusted accordingly. Then, at 616, it is determined whether the software application (or the hardware implementation) is to be ended.

If it is determined that the volumes for one or more audio sources are not to be changed, at 620, it is determined whether there are any previous user operations being detected. If there are no previous user operations being detected, at 614, one or more default volume curves are applied for the plurality of audio sources. Then, at 616, it is determined whether the software application (or the hardware implementation) is to be ended. If the software application (or the hardware implementation) is not to be ended, the process continues, at 604. If the software application (or the hardware implementation) is to be ended, at 618, the software application (or the hardware implementation) ends. Furthermore, if there are previous user operations being detected, then the process proceeds directly to determine whether the software application (or the hardware implementation) is to be ended. In certain embodiments, if it is determined that the volumes for one or more audio sources are not to be changed, one or more predetermined volume curves (e.g., the default volume curves) are applied for the plurality of audio sources.

In some embodiments, the HRTF parameters for the plurality of audio sources are stored in a data structure—hrtf[azimuth]. For example, the HRTF parameters for the plurality of audio sources are associated with a special representation of the plurality of audio sources in the three-dimensional space 200 as shown in FIG. 2. In certain embodiments, the HRTF parameters are applied to the plurality of audio sources using a convolution method:

$$y(n)=x(n)*hrtf(n) \tag{1}$$

where hrtf(n) represents HRTF parameters, x(n) represents an initial position of an audio source, and y(n) represents an updated position of the audio source.

Figure 9:
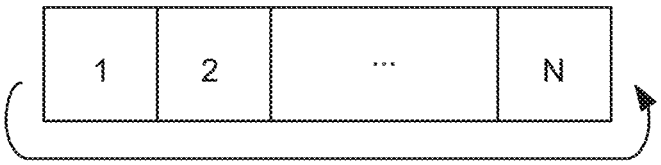
FIG. 9 depicts an example diagram showing a bar panel implemented on a user interface for control a virtual configuration of a plurality of audio sources.

FIG. 9 depicts an example diagram showing a bar panel implemented on a user interface for control a virtual configuration of a plurality of audio sources. As shown in FIG. 9, a plurality of regions (e.g., "1," "2," . . . , "N") on the bar panel correspond to the plurality of audio sources, and the configuration of the plurality of audio sources can be changed by a user operation (e.g., swiping, dragging, etc.) on the bar panel.

For example, the bar panel is used for a speaker of a mobile device (e.g., a smart phone, a tablet). The virtual configuration of the plurality of audio sources includes a line (or a plane) in front of the listener. The HRTF parameters include [−90°, 90° ], where −90° represents a leftmost direction, and 90° represents a rightmost direction.

Figure 10:
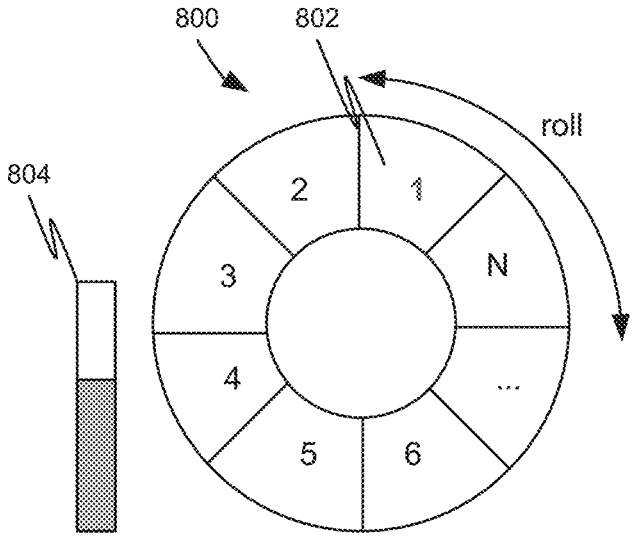
FIG. 10 depicts an example diagram showing volume control of audio sources.

FIG. 10 depicts an example diagram showing volume control of audio sources. As shown in FIG. 10, a region 802 on a ring panel 800 is selected, and an associated volume bar 804 appears so that a volume of an audio source corresponding to the region 802 is adjusted. Similarly, a volume bar may be implemented for a bar panel for volume control.

Figure 11:
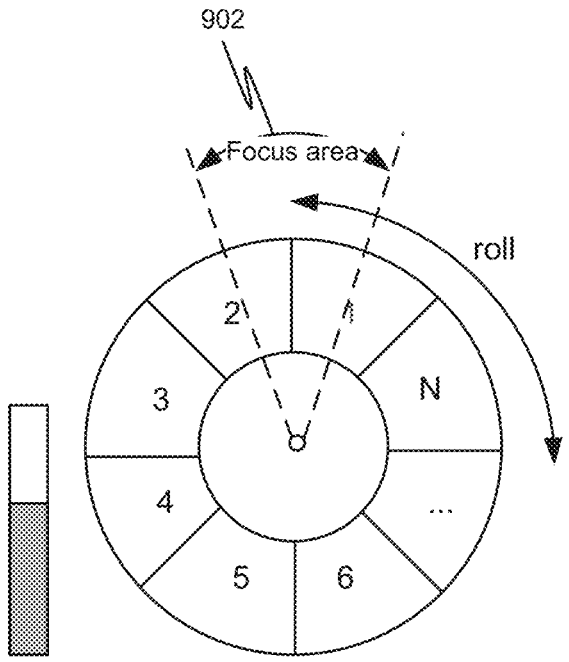
FIG. 11 depicts an example diagram showing an audio focus area on a ring panel.

FIG. 11 depicts an example diagram showing an audio focus area on a ring panel. As shown in FIG. 11, a focus area 902 corresponds to one or more audio sources in front of a listener. For example, under a default setting, the one or more audio sources associated with the focus area 902 is set to a largest volume, and other audio sources have smaller volumes (e.g., half of the largest volume, values from a default volume curve, etc.).

In some embodiments, when a new audio source is detected, the positions of all audio sources may be adjusted automatically (e.g., using a default setting) or adjusted by user operations in real time. For example, when the new audio source is detected, new HRTF parameters may be determined for all audio sources, and a new virtual configuration of all audio sources is determined based at least in part on the new HRTF parameters.

Figure 12:
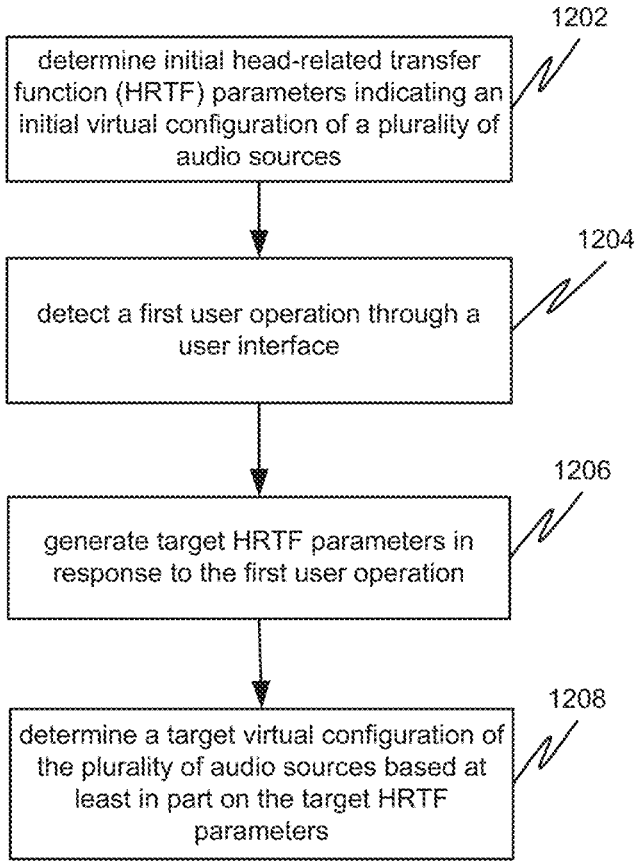
FIG. 12 depicts another example flow chart for audio management.

FIG. 12 depicts another flow chart for audio management. At 1202, initial head-related transfer function (HRTF) parameters indicating an initial virtual configuration of a plurality of audio sources are determined. At 1204, a user operation is detected through a user interface. At 1206, target HRTF parameters are generated in response to the user operation. At 1208, a target virtual configuration of the plurality of audio sources is determined based at least in part on the target HRTF parameters.

Figure 13:
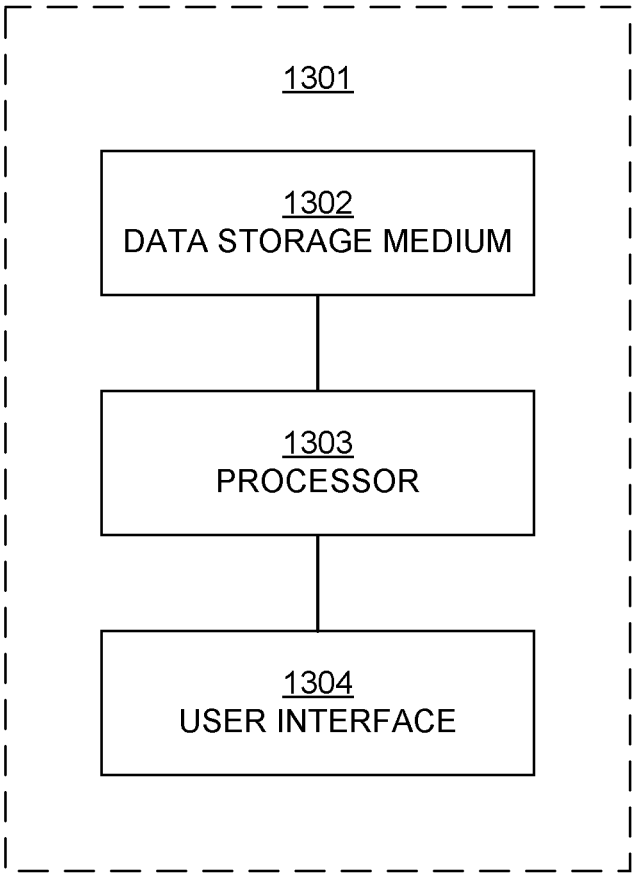
FIG. 13 depicts an example system for generating target HRTF parameters in response to a user operation.

As shown in FIG. 13, a system 1301 for audio management may include a computer-readable medium 1302. The medium 1302 may store an initial virtual configuration of a plurality of audio sources and initial HRTF parameters associated with the initial virtual configuration. A user interface 1304 may receive a user operation, for audio management, to change the initial virtual configuration. One or more data processors 1303 may (i) detect the user operation through the user interface 1304, (ii) generate target HRTF parameters in response to the user operation, (iii) store the target HRTF parameters in the computer-readable medium, (iv) determine a target virtual configuration of the plurality of audio sources based at least in part on the target HRTF parameters, and (v) store the target virtual configuration in the computer-readable medium 1302.

This written description uses examples to disclose the invention, include the best mode, and also to enable a person skilled in the art to make and use the invention. The patentable scope of the invention may include other examples that occur to those skilled in the art. Other implementations may also be used, however, such as firmware or appropriately designed hardware configured to carry out the methods and systems described herein. For example, the systems and methods described herein may be implemented in an independent processing engine, as a co-processor, or as a hardware accelerator. In yet another example, the systems and methods described herein may be provided on many different types of computer-readable media including computer storage mechanisms (e.g., CD-ROM, diskette, RAM, flash memory, computer's hard drive, etc.) that contain instructions (e.g., software) for use in execution by one or more processors to perform the methods' operations and implement the systems described herein.

What is claimed is:

1. A method for audio management, the method comprising:

determining initial head-related transfer function (HRTF) parameters indicating an initial virtual configuration of a plurality of audio sources;

detecting a first user operation, through a user interface, to change the initial virtual configuration;

generating target HRTF parameters in response to the first user operation; and determining a target virtual configuration of the plurality of audio sources based at least in part on the target HRTF parameters.

2. The method of claim 1, further comprising:

detecting the plurality of audio sources;

wherein the initial HRTF parameters are determined in response to the plurality of audio sources being detected.

3. The method of claim 1, wherein the user interface includes a panel that contains a plurality of regions corresponding to the plurality of audio sources.

4. The method of claim 3, wherein the user interface further includes one or more volume control components associated with the plurality of regions for adjusting volumes of the plurality of audio sources.

5. The method of claim 4, further comprising:

adjusting the volumes of the plurality of audio sources in response to a second user operation on the one or more volume control components.

6. The method of claim 1, further comprising:

applying one or more default volume curves to the plurality of audio sources in response to no user operations being detected.

7. The method of claim 1, further comprising:

in response to a new audio source being detected, generating new HRTF parameters for the plurality of audio sources and the new audio source; and determining a new virtual configuration of the plurality of audio sources and the new audio source based at least in part on the new HRTF parameters.

8. The method of claim 1, wherein:

the initial HRTF parameters are determined based at least in part on the one or more initial azimuth parameters of the plurality of audio sources;

the one or more initial azimuth parameters of the plurality of audio sources are changed in response to the first user operation to generate one or more target azimuth parameters; and the target HRTF parameters are determined based at least in part on the target azimuth parameters of the plurality of audio sources.

9. The method of claim 8, wherein the initial azimuth parameters include direction angles of the plurality of audio sources in a horizontal plane of a virtual three-dimensional space.

10. The method of claim 1, wherein:

the initial configuration of the plurality of audio sources indicates initial positions of the plurality of audio sources in a virtual three-dimensional space; and the target configuration of the plurality of audio sources indicates target positions of the plurality of audio sources in the virtual three-dimensional space.

11. The method of claim 1, wherein the target HRTF parameters are applied using a convolution algorithm.

12. A system for audio management, the system comprising:

one or more data processors; and a computer-readable storage medium encoded with instructions for commanding the one or more data processors to execute operations including:

determining initial head-related transfer function (HRTF) parameters indicating an initial virtual configuration of a plurality of audio sources;

detecting a first user operation, through a user interface, to change the initial virtual configuration;

generating target HRTF parameters in response to the first user operation; and determining a target virtual configuration of the plurality of audio sources based at least in part on the target HRTF parameters.

13. The system of claim 12, wherein the instructions are adapted for commanding the one or more data processors to execute further operations including:

detecting the plurality of audio sources;

wherein the initial HRTF parameters are determined in response to the plurality of audio sources being detected.

14. The system of claim 12, wherein the user interface includes a panel that contains a plurality of regions corresponding to the plurality of audio sources.

15. The system of claim 14, wherein the user interface further includes one or more volume control components associated with the plurality of regions for adjusting volumes of the plurality of audio sources.

16. The system of claim 15, wherein the instructions are adapted for commanding the one or more data processors to execute further operations including:

adjusting the volumes of the plurality of audio sources in response to a second user operation on the one or more volume control components.

17. The system of claim 12, wherein the instructions are adapted for commanding the one or more data processors to execute further operations including:

in response to a new audio source being detected, generating new HRTF parameters for the plurality of audio sources and the new audio source; and determining a new virtual configuration of the plurality of audio sources and the new audio source based at least in part on the new HRTF parameters.

18. The system of claim 12, wherein:

the initial HRTF parameters are determined based at least in part on the one or more initial azimuth parameters of the plurality of audio sources;

the one or more initial azimuth parameters of the plurality of audio sources are changed in response to the first user operation to generate one or more target azimuth parameters; and the target HRTF parameters are determined based at least in part on the target azimuth parameters of the plurality of audio sources.

19. The system of claim 12, wherein:

the initial configuration of the plurality of audio sources indicates initial positions of the plurality of audio sources in a virtual three-dimensional space; and the target configuration of the plurality of audio sources indicates target positions of the plurality of audio sources in the virtual three-dimensional space.

20. A system for audio management, the system comprising:

a computer-readable medium configured to store an initial virtual configuration of a plurality of audio sources and initial head-related transfer function (HRTF) parameters associated with the initial virtual configuration of the plurality of audio sources;

a user interface configured to receive a user operation, for audio management, to change the initial virtual configuration; and one or more data processors configured to:

detect the user operation through the user interface;

generate target HRTF parameters in response to the user operation;

store the target HRTF parameters in the computer-readable medium;

determine a target virtual configuration of the plurality of audio sources based at least in part on the target HRTF parameters; and store the target virtual configuration in the computer-readable medium.

* * * * *